US010322501B2

(12) United States Patent
Garber et al.

(10) Patent No.: US 10,322,501 B2
(45) Date of Patent: Jun. 18, 2019

(54) FASTENING TOOL HAVING TIMED READY TO FIRE MODE

(71) Applicant: BLACK & DECKER INC., New Britain, CT (US)

(72) Inventors: Stuart E. Garber, Towson, MD (US); Dean R. Edwards, Bel Air, MD (US)

(73) Assignee: Black & Decker Inc., New Britain, CT (US)

( * ) Notice: Subject to any disclaimer, the term of this patent is extended or adjusted under 35 U.S.C. 154(b) by 452 days.

(21) Appl. No.: 14/994,523

(22) Filed: Jan. 13, 2016

(65) Prior Publication Data

US 2016/0207185 A1 Jul. 21, 2016

Related U.S. Application Data

(60) Provisional application No. 62/104,151, filed on Jan. 16, 2015.

(51) Int. Cl.
*B25C 1/00* (2006.01)
*B25C 1/06* (2006.01)

(52) U.S. Cl.
CPC ..... *B25C 1/008* (2013.01); *B25C 1/06* (2013.01)

(58) Field of Classification Search
CPC ..... B25C 1/06; B25C 1/008
USPC ..... 227/117, 133, 147; 173/1–11
See application file for complete search history.

(56) References Cited

U.S. PATENT DOCUMENTS 4,519,535 A * 5/1985 Crutcher ..... B25C 1/06 227/120
7,204,403 B2 4/2007 Kenney et al.
7,575,142 B2 * 8/2009 Liang ..... B25C 1/06 227/129
7,637,408 B2 * 12/2009 Takahashi ..... B25C 5/15 227/120
7,934,565 B2 * 5/2011 Krondorfer ..... B25C 1/06 173/1
8,302,833 B2 11/2012 Gross et al.
2005/0217416 A1 10/2005 Berry et al.
2005/0220445 A1 * 10/2005 Baskar ..... B25C 1/06 388/811
2008/0223894 A1 * 9/2008 Cruise ..... B25C 1/008 227/2
2009/0108046 A1 * 4/2009 Huang ..... B25C 1/008 227/8

(Continued)

*Primary Examiner* — Robert F Long
(74) *Attorney, Agent, or Firm* — Harness, Dickey & Pierce, PLC

(57) ABSTRACT

A fastening tool and method of operating a fastening tool can include a driver, a motor, a flywheel driven by the motor, an actuator, and a controller. The actuator can cause the driver to engage with the flywheel to cause the driver to move along an axis. The controller can selectively operate the motor and selectively operate the actuator. In a first state, the controller will not operate the actuator unless the contact trip switch and the trigger switch are both actuated, the contact trip switch being actuated prior to actuation of the trigger switch, and the flywheel is rotating at a first predetermined speed. When the controller is in the first state, the controller can operate the motor to rotate the flywheel at a second predetermined speed until the earlier of a second predetermined period of time after operation of the actuator, or a subsequent operation of the actuator.

11 Claims, 6 Drawing Sheets

(56) References Cited

U.S. PATENT DOCUMENTS

| | | | | |
|---|---|---|---|---|
| 2009/0250500 | A1* | 10/2009 | Brendel | B25C 1/06 227/132 |
| 2010/0116863 | A1* | 5/2010 | Suda | B25C 1/008 227/8 |
| 2010/0301091 | A1* | 12/2010 | Liang | B25C 1/008 227/8 |
| 2011/0057014 | A1* | 3/2011 | Yang | B25C 1/008 227/8 |
| 2011/0114692 | A1* | 5/2011 | Liang | B25C 1/04 227/2 |
| 2011/0132959 | A1* | 6/2011 | Hlinka | B25C 1/008 227/8 |
| 2013/0306699 | A1 | 11/2013 | Baskar et al. | |

* cited by examiner

FASTENING TOOL HAVING TIMED READY TO FIRE MODE

CROSS-REFERENCE TO RELATED APPLICATIONS

This application claims the benefit of U.S. Provisional Application No. 62/104,151, filed on Jan. 16, 2015. The entire disclosure of the above application is incorporated herein by reference.

FIELD

The present disclosure relates in general to the field of fastening tools and more particularly to a fastening tool with a mode selector switch that permits the fastening tool to be operated in a timed ready to fire mode.

BACKGROUND

This section provides background information related to the present disclosure which is not necessarily prior art.

Fastening tools, such as power nailers and staplers, are relatively common place in the construction trades. Often times, however, the fastening tools that are available may not provide the user with a desired degree of flexibility and freedom due to the presence of hoses and other attachments that couple the fastening tool to a source of pneumatic power.

Recently, several types of cordless fastening tools have been introduced to the market in an effort to satisfy the demands of modern consumers. Some of these fastening tools, however, are relatively large in size and/or weight, which render them relatively cumbersome to work with. Others require relatively expensive fuel cartridges that are not refillable by the user so that when the supply of fuel cartridges has been exhausted, the user must leave the work site to purchase additional fuel cartridges. Yet, other cordless fastening tools are relatively complex in their design and operation so that they are relatively expensive to manufacture and do not operate in a robust manner that reliably sets fasteners into a workpiece in a consistent manner.

Under some circumstances, some operators may find the speed of operation of the preferred cordless electrically powered fastening tools to be somewhat less than desirable, such as when using these tools in full sequential mode. After operating the electrically powered tool in this mode to drive a fastener, the tool must create and store the kinetic energy in a flywheel before it can discharge a second or subsequent fastener. Current electrically powered tools can require a delay of 0.3-1.0 seconds to create and store the required kinetic energy before the second or subsequent fastener can be discharged. The current electrically powered tools can be operated in a bump mode, which can reduce the time between the cycling of the tool by providing rotary power to the flywheel anytime the trigger is pulled to close a trigger switch. Bump mode operation, however, is not preferred in certain instances. Accordingly, there remains a need in the art for an improved fastening tool.

SUMMARY

This section provides a general summary of some aspects of the present disclosure and is not a comprehensive listing or detailing of either the full scope of the disclosure or all of the features described therein.

In one form, the present invention provides a fastening tool for installing fasteners into a workpiece. The fastening tool can include a contact trip switch, which is actuated in response to a first operator input, a trigger switch, which is actuated in response to a second operator input, a driver that is movable along an axis, a motor assembly and a controller. The motor assembly can have a flywheel, which can be driven by a motor, and an actuator that can be actuated to drive the driver into engagement with the flywheel to cause the driver to move along the axis. The controller can be configured to selectively activate the motor assembly to cause the driver to translate along the axis at least partially in response to actuation of the contact trip switch and the trigger switch. The controller can include a mode selector switch having a first switch state and a second switch state. Placement of the mode selector switch into the first switch state requires that the contact trip switch be actuated prior to actuation of the trigger switch before the controller actuates the actuator. Placement of the mode selector switch into the second switch state permits the controller to bring the flywheel to firing speed without input from the operator after a completed firing sequence, for a predetermined period of time, pending input from the operator.

In an embodiment of the present invention, the fastening tool includes a two-position mode selector switch for selecting either a "sequential mode" or a "rapid sequential mode" for firing a fastening tool. In the rapid sequential mode, the flywheel immediately rises to the firing speed after a completed firing sequence without user input, the contact trip actuation followed by trigger switch actuation sequence is always required to discharge a fastener. Additionally, if the tool is at rest and the contact trip is actuated, the flywheel will rise to the firing speed.

After each nail is shot, the "rapid sequential" mode allows the flywheel to rotate at full or firing speed, and maintain the speed for a predetermined time, such as, for example, 1-3, 4 or 5 seconds, pending input from the contract trip first and the trigger switch second. If the contact trip is not pressed into a workpiece by the user within the predetermined time, the tool "times out" and the flywheel ceases to be energized and comes to rest.

In one form, a fastening tool for installing fasteners into a workpiece includes a contact trip switch, a trigger switch, a driver, a motor assembly, and a controller. The driver can be movable along a driver axis. The motor assembly can include a motor, a flywheel, and an actuator. The flywheel can be driven by the motor. The actuator can be configured to cause the driver to engage with the flywheel to cause the driver to move along the driver axis. The controller can be configured to selectively operate the motor and to selectively operate the actuator. When the controller is in a first state, the controller will not operate the actuator unless: a) the contact trip switch and the trigger switch are both actuated, b) the contact trip switch is actuated prior to actuation of the trigger switch, and c) the flywheel is rotating at least at a first predetermined speed. When the controller is in the first state, the controller can operate the motor to rotate the flywheel at a second predetermined speed until the earlier of: a) a second predetermined period of time after operation of the actuator, or b) a subsequent operation of the actuator.

In one form, a method of operating a fastening tool can include operating the fastening tool in a first mode. Operating the fastening tool in the first mode can include sensing actuation of a contact trip switch, operating a motor to rotate a flywheel at a first predetermined speed, sensing actuation of a trigger switch, determining a speed of the flywheel, operating an actuator to engage a driver with the flywheel in response to the contact trip switch and the trigger switch being actuated. The operating of the actuator occurs only if the trigger switch is actuated after the contact trip switch is actuated and the flywheel is rotating at the first predetermined speed. The method can also include operating the motor to rotate the flywheel at a second predetermined speed for a second predetermined amount of time in response to the operating of the actuator.

In one form, a method of operating a fastening tool can include operating the fastening tool in a first mode. Operating the fastening tool in the first mode can include transferring kinetic energy from a flywheel to a driver to move the driver along a driver axis in response to a first set of conditions being met. The first set of conditions can include a contact trip switch being actuated, a trigger switch being actuated, the trigger switch being actuated after the contact trip switch is actuated, and the flywheel rotating at a first predetermined speed. The method can include supplying electrical current to a motor to rotate the flywheel at a second predetermined speed for a second predetermined amount of time following the transfer of kinetic energy from the flywheel to the driver.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
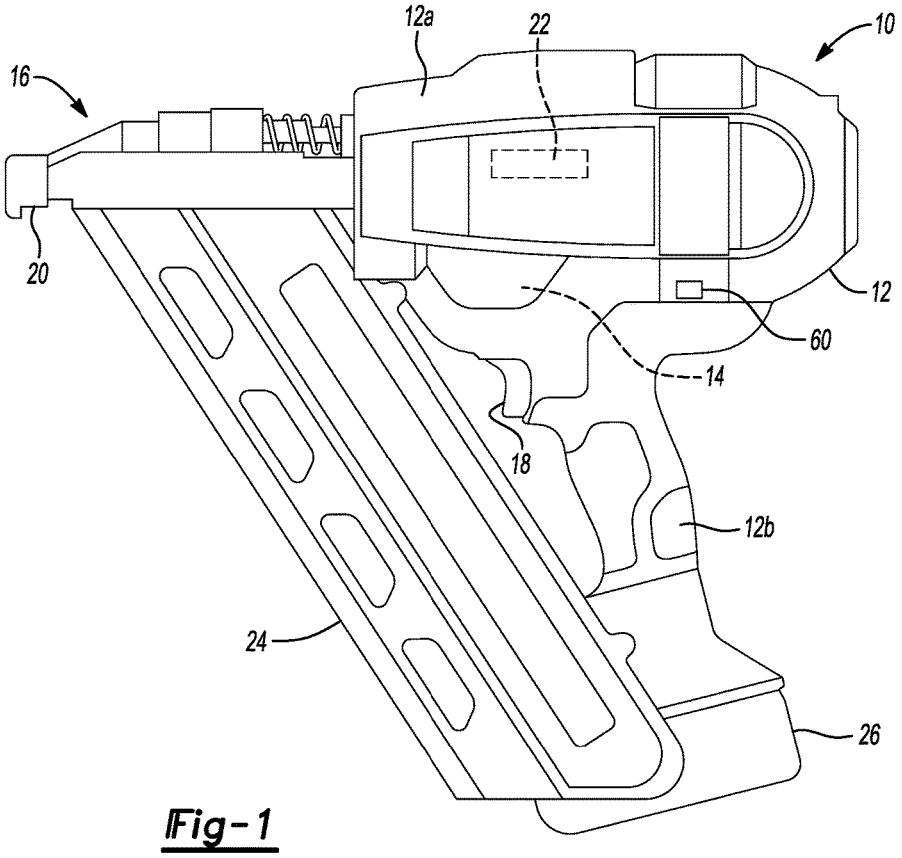
FIG. 1 is a side elevation view of an exemplary fastening tool constructed in accordance with the teachings of the present disclosure.

Example embodiments will now be described more fully with reference to the accompanying drawings. The following description is merely exemplary in nature and is in no way intended to limit the present teachings, application, or uses. Throughout this specification, like reference numerals will be used to refer to like elements.

Referring now more particularly to the drawings, FIG. 1 illustrates a fastening tool constructed in accordance with the teachings of the present invention.

With continuing reference to FIG. 1 and additional reference to FIG. 2, the fastening tool 10 may include a housing 12, a motor assembly 14, a nosepiece assembly 16, a trigger 18, a contact trip 20, a control unit 22, a magazine 24, and a battery 26, which provides electrical power to the various sensors (which are discussed in detail, below) as well as the motor assembly 14 and the control unit 22. Those skilled in the art will appreciate from this disclosure, however, that in place of, or in addition to the battery 26, the fastening tool 10 may include an external power cord (not shown) for connection to an external power supply (not shown). Thus, the fastening tool is electrically powered by a suitable electric power source or electric energy storage device, such as the battery 26.

Furthermore, while aspects of the present invention are described herein and illustrated in the accompanying drawings in the context of a fastening tool, those of ordinary skill in the art will appreciate that the invention, in its broadest aspects, has further applicability. For example, the drive motor assembly 14 may also be employed in various other mechanisms that use reciprocating motion, including rotary hammers, hole forming tools, such as punches, and riveting tools, such as those that install deformation rivets.

The housing 12 may include a body portion 12*a*, which may be configured to house the motor assembly 14 and the control unit 22, and a handle 12*b*. The handle 12*b* may provide the housing 12 with a conventional pistol-grip appearance and may be unitarily formed with the body portion 12*a* or may be a discrete fabrication that is coupled to the body portion 12*a*, as by threaded fasteners (not shown). The handle 12*b* may be contoured so as to ergonomically fit a user's hand and/or may be equipped with a resilient and/or non-slip covering, such as an overmolded thermoplastic elastomer.

The motor assembly 14 may include a driver 28 and a power source 30 that is configured to selectively transmit power to the driver 28 to cause the driver 28 to translate along an axis. In the particular example provided, the power source 30 includes an electric motor 32, a flywheel 34, which is coupled to an output shaft 32*a* of the electric motor 32, a pinch roller assembly 36, and an actuator 44. In operation, fasteners F are stored in the magazine 24, which sequentially feeds the fasteners F into the nosepiece assembly 16.

The motor assembly 14 may be actuated by the control unit 22 to cause the driver 28 to translate and impact a fastener F in the nosepiece assembly 16 so that the fastener F may be driven from the nosepiece assembly 16 and into a workpiece (not shown). Actuation of the power source 30 may utilize electrical energy from the battery 26 to operate the motor 32 and the actuator 44. The motor 32 is employed to drive the flywheel 34, while the actuator 44 is employed to move a roller 46 that is associated with a roller assembly 36. The motor 32 can be drivingly coupled to the flywheel 34 in any suitable manner.

In the example provided, the motor 32 is drivingly coupled to the flywheel 34 via a belt 32*b* drivingly coupled to the output shaft 32*a* of the motor 32 and an input 34*a* of the flywheel 34. In an alternative construction, not specifically shown, the motor 32 can be directly connected to the flywheel 34. For example, the motor 32 can be an inside-out or outer-rotor brushed or brushless motor, having the rotor of the motor 32 disposed about the stator coils of the motor 32. In such a configuration, the rotor of the motor 32 can be integrally formed with or fixedly coupled to the flywheel 34 for common rotation about the stator of the motor 32.

Returning to the example provided, the roller assembly 36 presses the driver 28 into engagement with the flywheel 34 so that mechanical energy may be transferred from the flywheel 34 to the driver 28 to cause the driver 28 to translate along the axis. The nosepiece assembly 16 guides the fastener F as it is being driven into the workpiece (not shown). A return mechanism (not shown) can include a spring member that biases the driver 28 into a returned position.

The trigger 18 may be coupled to the housing 12 and is configured to receive an input from the user, typically by way of the user's finger, which may be employed in conjunction with a trigger switch 18*a* to generate a trigger signal that may be employed in whole or in part to initiate the cycling of the fastening tool 10 to install a fastener F to a workpiece (not shown).

The contact trip 20 may be coupled to the nosepiece assembly 16 for sliding movement thereon. The contact trip 20 is configured to slide rearwardly in response to contact with a workpiece (not shown) and may interact either with the trigger 18 or a contact trip sensor or switch 50. In the former case, the contact trip 20 cooperates with the trigger 18 to permit the trigger 18 to actuate the trigger switch 18*a* to generate the trigger signal. More specifically, the trigger 18 may include a primary trigger, which is actuated by a finger of the user, and a secondary trigger, which is actuated by sufficient rearward movement of the contact trip 20. Actuation of either one of the primary and secondary triggers will not, in and of itself, cause the trigger switch 18*a* to generate the trigger signal. Rather, both the primary and the secondary trigger must be placed in an actuated condition to cause the trigger switch 18*a* to generate the trigger signal.

In the latter case (i.e., where the contact trip 20 interacts with the contact trip switch 50), which is employed in the example provided, rearward movement of the contact trip 20 by a sufficient, predetermined amount causes the contact trip switch 50 to generate a contact trip signal, which may be employed in conjunction with the trigger signal to initiate the cycling of the fastening tool 10 to install a fastener F to a workpiece.

The control unit 22 may include a power source sensor 52, a controller 54, an indicator (not shown), such as a light and/or a speaker, and a mode selector switch 60. The power source sensor 52 is configured to sense a condition in the power source 30 that is indicative of a level of kinetic energy of an element in the power source 30 and to generate a sensor signal in response thereto. For example, the power source sensor 52 may be operable for sensing a speed of the output shaft 32*a* of the motor 32 or of the flywheel 34. As one of ordinary skill in the art would appreciate from this disclosure, the power source sensor 52 may sense the characteristic directly or indirectly. For example, the speed of the motor output shaft 32*a* or flywheel 34 may be sensed directly, as through encoders, eddy current sensors or Hall Effect sensors, or indirectly, as through the back electromotive force ("back EMF") of the motor 32.

In the particular example provided, the power source sensor 52 includes three Hall Effect sensor cells (not shown) that are fixed relative to the housing 12 (FIG. 1) and are angularly spaced about one of the rotating components of the power source 30 (e.g., the rotor of the motor 32, the output shaft 32*a*, the flywheel 34, or the input 34*a*). A permanent magnet (not shown) can be fixedly mounted to that rotating component of the power source 30 (e.g., the rotor of the motor 32, the output shaft 32*a*, the flywheel 34, or the input 34*a*) such that each Hall Effect sensor cell senses the permanent magnet as it rotates past the respective Hall Effect sensor cell and can responsively generate a sensor signal that can be received by the controller 54. Thus, the controller 54 can determine the rotational speed of the flywheel 34 based on the sensor signals generated by the Hall Effect sensor cells.

In an alternative construction (not specifically shown), back EMF can be used to detect rotational speed of the flywheel 34. The back EMF is produced when the motor 32 is not powered by the battery 26 but rather driven by the speed and inertia of the components of the motor assembly 14 (especially the flywheel 34 in the example provided).

In the particular example provided, the mode selector switch 60 is a two-position switch that permits the user to select either a sequential fire mode or a rapid sequential mode. In an alternative construction, the mode selector switch 60 can include additional positions for additional modes, such as a bump mode for example. The mode selector switch 60 may be a switch that produces a mode selector switch signal that is indicative of a desired mode of operation of the fastening tool 10. The controller 54 may be configured such that the fastening tool 10 will be operated in a given mode, such as the rapid sequential mode, only in response to the receipt of a specific signal from the mode selector switch 60. The placement of the mode selector switch 60 in a first position causes a signal of a predetermined first voltage to be applied to the controller 54, while the placement of the mode selector switch 60 in a second position causes a signal of a predetermined second voltage to be applied to the controller 54. Limits may be placed on the voltage of one or both of the first and second voltages, such as +−0.2V, so that if the voltage of one or both of the signals is outside the limits the controller 54 may default to a given firing mode (e.g., to the sequential firing mode) or operational condition (e.g., inoperative).

The controller 54 may be coupled to the mode selector switch 60, the trigger switch 18*a*, the contact trip switch 50, the motor 32, the power source sensor 52 and the actuator 44. In response to receipt of the trigger sensor signal and the contact trip sensor signal, the controller 54 determines whether the two signals have been generated at an appropriate time relative to the other (based on the mode selector switch 60 and the mode selector switch signal). If the order in which the trigger sensor signal and the contact trip sensor signal is not appropriate (i.e., not permitted based on the setting of the mode selector switch 60), the controller 54 does not enable electrical power to flow to the actuator 44. To reset the fastening tool 10, the user may be required to deactivate one or both of the trigger switch 18*a* and the contact trip switch 50 (e.g., release the trigger 18 and/or remove the contact trip 20 from the workpiece).

If the order in which the trigger sensor signal and the contact trip sensor signal is appropriate (i.e., permitted based on the setting of the mode selector switch 60 and the contact trip sensor signal being generated before the trigger sensor signal), the controller 54 enables electrical power to flow to the actuator 44, which causes the firing of the driver 28.

Sequential Mode

One mode of operation may be, for example, the sequential mode, wherein the contact trip 20 must first be abutted against a workpiece (so that the contact trip switch 50 generates the contact trip sensor signal) and thereafter (while the contact trip 20 is maintained in abutment with the workpiece) the trigger switch 18*a* is actuated to generate the trigger signal. In the sequential mode, the controller 54 operates the motor 32 to ramp the flywheel 34 up to a predetermined speed (e.g., a firing speed) when the contact trip 20 is actuated. The controller 54 can also be configured to operate the motor 32 to ramp the flywheel 34 up to predetermined speed when the user interacts with the fastening tool 10 in another way that indicates a desire to use the fastening tool, such as actuating the trigger 18 for example. Operation in the sequential mode is described in greater detail below with reference to FIGS. 3 and 4.

Figure 2:
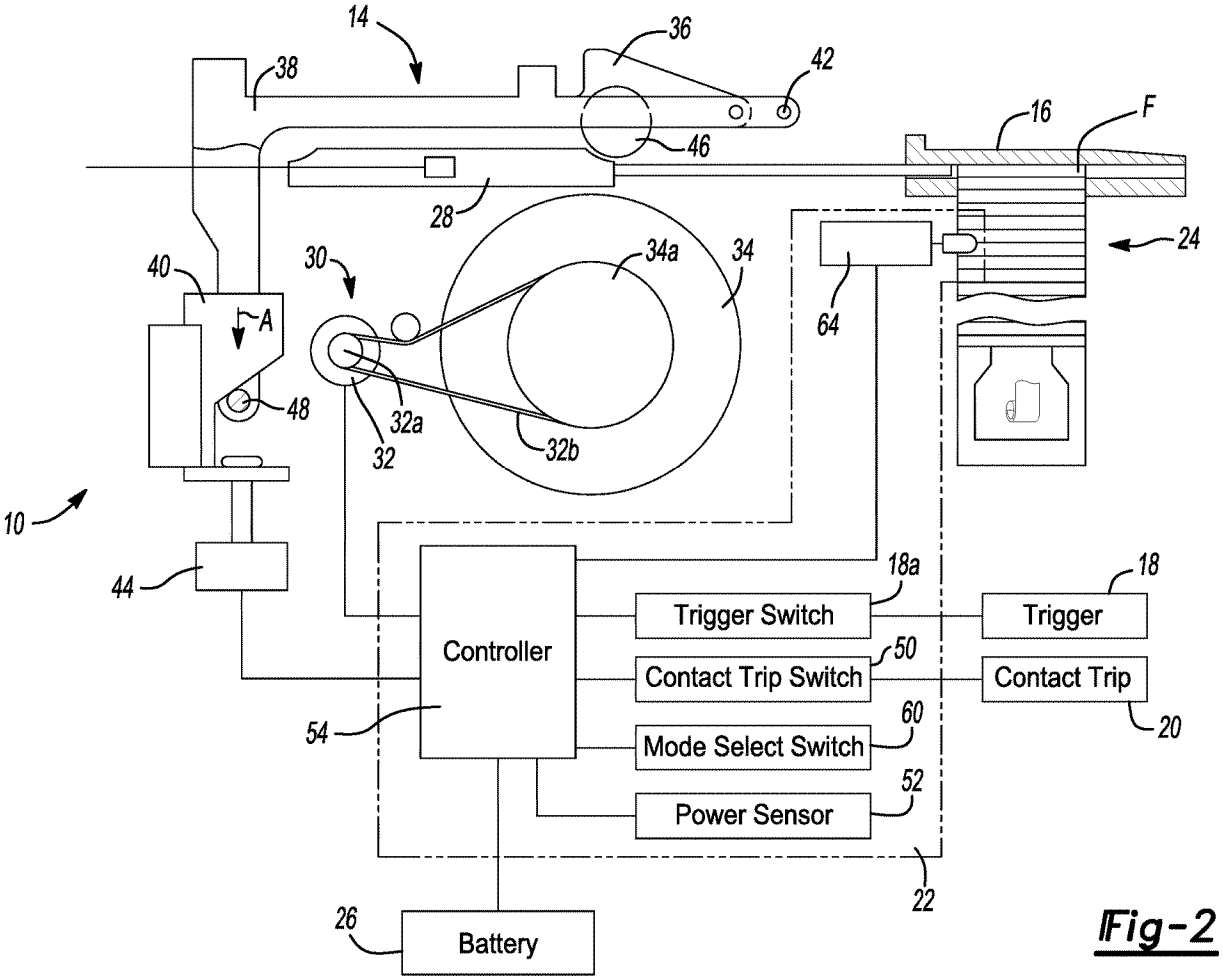
FIG. 2 is a schematic view of a portion of the fastening tool of FIG. 1 illustrating various components including the motor assembly and the controller.
Figure 3:
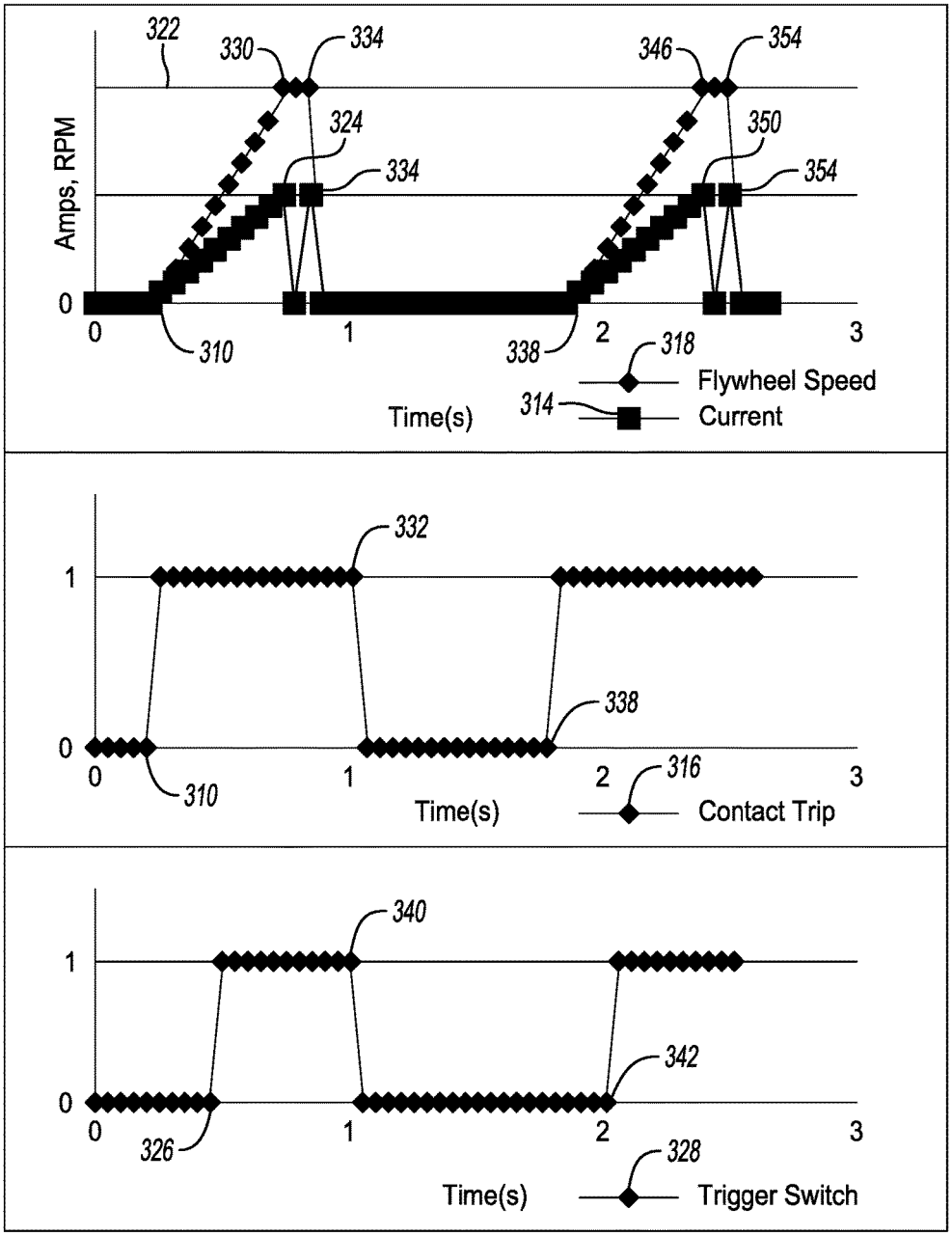
FIG. 3 is a plot illustrating the time-current values for a sequential mode of operation.

With continued reference to FIG. 2 and additional reference to FIG. 3, FIG. 3 illustrates a graphical timeline of an example firing sequence in the sequential mode. Line 314 can represent electrical current flowing from the battery 26 (e.g., via the controller 54), with a value of 0 representing when no current flows from the battery 26. Increased current (e.g., amps) is represented with increased vertical position. Line 318 can represent the rotational speed of the flywheel 34. Increased rotational speed (e.g., revolutions per minute) is represented with increased vertical position. Line 316 can represent the status of the contact trip switch 50, with a value of 0 representing an off status, and a value of 1 representing an actuated status. Line 328 can represent the status of the trigger switch 18*a*, with a value of 0 representing an off status, and a value of 1 representing an actuated status. The horizontal axes represent time in seconds.

At point 310, the contact trip switch 50 is actuated, and the controller 54 causes electrical current 314 to flow to the motor 32. In the example provided, the current 314 to the motor 32 increases over time at a steady rate causing the speed 318 at which the flywheel 34 rotates to increase at a steady rate. The speed 318 of the flywheel 34 can increase until reaching a first predetermined speed 322 (e.g., the firing speed). In the example provided, the first predetermined speed 322 is approximately 13,000 revolutions per minute, though other configurations can be used. In the example provided, the current 314 increases at a rate such that the flywheel 34 reaches the first predetermined speed 322 in approximately 0.5 seconds, though other configurations can be used. In the example provided, the controller 54 is configured to limit the maximum current output to the motor 32 to a predetermined current limit (e.g., 60 amps), though other configurations can be used. In the example provided, the current 314 increases at a rate such that the speed 318 of the flywheel 34 reaches the first predetermined speed 322 before the current 314 reaches the predetermined current limit.

In an alternative configuration, not specifically shown, the current 314 can rise at a faster rate, such that the current 314 reaches the predetermined current limit prior to the flywheel 34 reaching the first predetermined speed 322. In such a configuration, the current 314 can be applied at a constant magnitude at the predetermined current limit until the flywheel 34 reaches the first predetermined speed 322. Alternatively, the current 314 can repeatedly drop below the predetermined current limit and ramp back up to the predetermined current limit until the flywheel 34 reaches the first predetermined speed 322

Returning to the example provided, the first predetermined speed 322 can be sufficient to drive the driver 28 to fire the fastener F into the workpiece (not shown). When the flywheel 34 reaches the first predetermined speed 322, the current 314 to the motor 32 can be reduced or intermittently shut off to maintain the flywheel 34 at or above the first predetermined speed 322 until the kinetic energy of the flywheel 34 is needed for firing. In the example provided, the flywheel 34 reaches the first predetermined speed 322 at point 330 and the current 314 to the motor 32 is shut off at point 324.

In the example provided, the trigger switch 18*a* is actuated at point 326. In the example provided, the contact trip switch 50 is still actuated, the trigger switch 18*a* is actuated at point 326, the trigger switch 18*a* was actuated after the contact trip switch 50, and the flywheel 34 is at the first predetermined speed 322. Thus, the controller 54 activates the actuator 44 by providing electrical current 314 to the actuator 44 at point 334. Electrical current 314 can be applied to the actuator 44 in a pulse over a predetermined amount of time (e.g., approximately 30 milliseconds). At point 334, the actuator 44 can cause the driver 28 to engage the flywheel 34 to fire the fastener F, as described above.

In other words, the conditions required for firing the fastener in sequential mode can be: the contact trip switch 50 is currently actuated, the trigger switch 18*a* is currently actuated, the trigger switch 18*a* was actuated after the contact trip switch 50, and the speed 318 of the flywheel 34 is at the first predetermined speed 322. Thus, in the example provided, despite the trigger switch 18*a* being actuated at point 326, after point 310, the fastening tool 10 does not operate the actuator 44 to fire the fastener F until the flywheel 34 reaches the first predetermined speed 322 at point 330. In the example provided, electrical current 314 is not provided to the motor 32 while the actuator 44 is operated and is not provided while the driver 26 engages the flywheel 34.

While not specifically shown in FIG. 3, if the flywheel 34 reaches the first predetermined speed 322 before the trigger switch 18*a* is actuated, the current 314 can be reduced to maintain the speed 318 at the first predetermined speed 322 until the trigger switch 18*a* is actuated (e.g., to fire the fastener F), the contact trip switch 50 is no longer actuated (e.g., to turn off power to the motor 32), or for a predetermined amount of time (e.g., 10 seconds then turning off power to the motor 32), whichever occurs first.

After firing the fastener F, there is no current to the motor 32, and thus the speed 318 of the flywheel 34 reduces due to the transfer of kinetic energy to the driver 26. The magnitude of the reduction of speed 318 due to the firing of the fastener F can depend on the type of fastener F and/or the type of work piece (not shown) used. In the example provided, all of the kinetic energy of the flywheel 34 is lost in the firing process and the speed 318 returns to zero until the contact trip switch 50 is again actuated (e.g., at point 338). In an alternative configuration, actuation of the trigger switch 18*a* or another input by the user indicative of intent to use the fastening tool 10, subsequent to the firing can cause the controller 54 to provide power to the motor 32.

After firing the fastener F, the return mechanism (not shown) can cause the driver 26 to return to its original axial position, and a new fastener F can be positioned for subsequent firing.

In the example provided, the contact trip switch 50 is released at point 332 and the trigger switch 18*a* is released at point 340. The contact trip switch 50 is next actuated at point 338, causing the controller 54 to provide electric current 314 to the motor 32 and speed up the flywheel 34. When the contact trip switch 50 is actuated at point 338, the current 314 to the motor 32 is ramped up in a similar manner as when the contact trip switch 50 was actuated at point 310. The trigger switch 18*a* is next actuated at point 342, after point 338, but before the flywheel 34 has reached the first predetermined speed 322 at point 346. In the example provided, at point 350, the electric current 314 to the motor is turned off since the flywheel 34 has reached the predetermined speed 322. With the current 314 to the motor 32 off, a pulse of current 314 can flow to the actuator 44 point 354 to cause the driver 26 to engage the flywheel 34 at point 354. Thus, when in sequential mode, there is a delay of time between when firing is requested by the user (e.g., actuation of the trigger 18) and the subsequent firing of the fastener F, which must wait until the flywheel 34 reaches the first predetermined speed 322.

Figure 4:
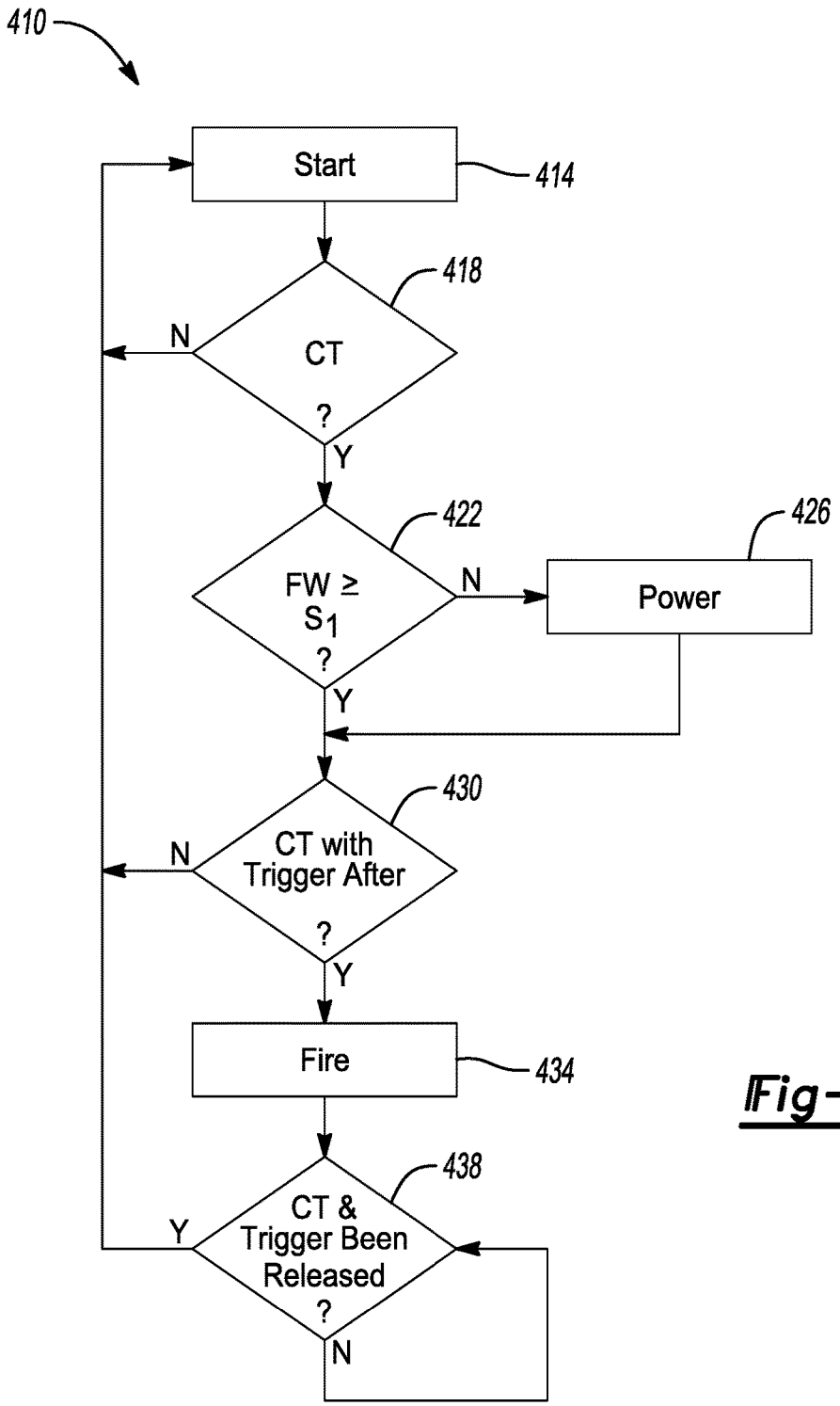
FIG. 4 is a diagram of a logic routine for operating the fastening tool of FIG. 1 in the sequential mode.

With continued reference to FIGS. 2 and 3, and additional reference to FIG. 4, FIG. 4 illustrates an example diagram of a logic routine 410 for use by the controller when in the sequential mode. The logic routine 410 can begin at step 414 and proceed to step 418. At step 418, the controller 54 can check if the contact trip switch 50 has been actuated. If the contact trip switch 50 has not been actuated, then the logic routine 410 can return to step 414. If the contact trip switch 50 is actuated, then the logic routine 410 can proceed to step 422.

At step 422, the controller 54 can check if the speed 318 of the flywheel 34 is greater than or equal to the first predetermined speed 322. If the speed 318 is not greater than or equal to the first predetermined speed 322, then the logic routine 410 can proceed to step 426. At step 426, the controller 54 can cause electrical current 314 to flow to the motor 32 to speed up the flywheel 34 until the speed 318 is greater than or equal to the first predetermined speed 322. In the example provided, the amplitude of the electrical current 314 can be ramped up, as shown in FIG. 3 (e.g., between points 310 and 324), or ramped up and then held constant at the first predetermined speed 322 until all conditions for firing the fastener F are met, or for the predetermined amount of time (e.g., 10 seconds), as discussed above. After step 426, the logic routine 410 can proceed to step 430.

Returning to step 422, if the speed 318 of the flywheel 34 is greater than or equal to the first predetermined speed 322, then the logic routine 410 can proceed to step 430. At step 430, the controller 54 can check if the contact trip switch 50 was actuated after the trigger switch 18*a*. If the trigger switch 18*a* was actuated before the contact trip switch 50, then the logic routine 410 can return to step 414. If the trigger switch 18*a* was actuated after the contact trip switch 50, then the logic routine 410 can proceed to step 434. In an alternative construction, not specifically shown, the controller 54 can check the order of actuation of the trigger switch 18*a* and the contact trip switch 50 before checking the speed 318 of the flywheel 34.

At step 434, the controller 54 can turn off power to the motor 32 and activate the actuator 44 to cause the driver 28 to engage the flywheel 34 and fire the fastener F, as described above (e.g., at points 324 and 334 of FIG. 3). After firing the fastener F, the logic routine 410 can proceed to step 438 without applying power to the motor 32. At step 438, the controller 54 can check if both of the contact trip 20 and the trigger switch 18*a* have been released. Once the contact trip 20 and the trigger switch 18*a* have been released, the logic routine 410 can return to step 414. Thus, in the example provided, power is not provided to the motor 32 after firing a fastener F, and a subsequent fastener F cannot be fired until both the contact trip 20 and the trigger switch 18*a* have been released.

Rapid Sequential Mode

Another mode of operation may be the rapid sequential mode, wherein, similar to the sequential mode, the contact trip 20 must first be abutted against a workpiece and thereafter the trigger switch 18*a* is actuated to generate the trigger signal. After a shot is fired (e.g., a fastener F is driven from the nosepiece assembly 16), the motor 32 is operated to cause the flywheel 34 to ramp up to a second predetermined speed with no input from the user. The second predetermined speed can be the same as the first predetermined speed (e.g. the firing speed). As with the sequential mode, both the contact trip 20 and the trigger switch 18*a* must be released to enable the next firing sequence. When the contact trip 20 and the trigger switch 18*a* are actuated again (in that order only) then the next shot can be fired. In the example provided, the second predetermined speed is the firing speed and the second shot can be fired without delay. Operation in the rapid sequential mode is described in greater detail below with reference to FIGS. 5 and 6.

In an alternative configuration of the rapid sequential mode, the second predetermined speed is less than the firing speed but greater than the speed at which the flywheel 34 spins immediately after completing a firing sequence. In this alternative configuration, the flywheel 34 can be ramped up to the firing speed after additional input by the user (e.g., actuation of the contact trip 20 or trigger switch 18*a*) with significantly less delay than if the flywheel 34 is needed to be ramped up from its reduced speed immediately after a firing sequence.

Figure 5:
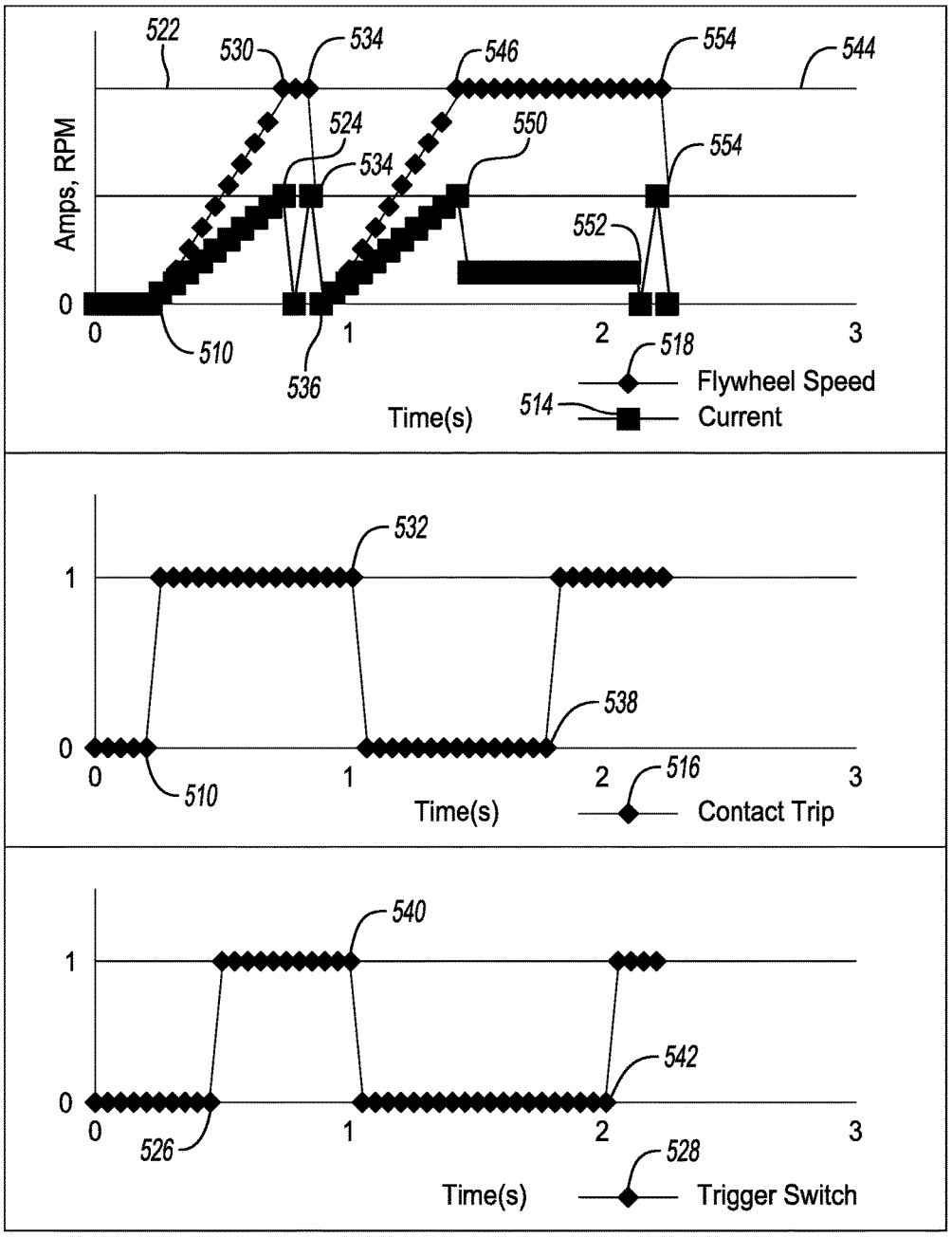
FIG. 5 is a plot illustrating the time-current values for a rapid sequential mode of operation.

With continued reference to FIG. 2, and additional reference to FIG. 5, FIG. 5 illustrates a graphical timeline of a firing sequence in the rapid sequential mode. Line 514 can represent electrical current flowing from the battery 26 (e.g., via the controller 54), with a value of 0 representing when no current flows from the battery 26. Increased current (e.g., amps) is represented with increased vertical position. Line 518 can represent the rotational speed of the flywheel 34. Increased rotational speed (e.g., revolutions per minute) is represented with increased vertical position. Line 516 can represent the status of the contact trip switch 50, with a value of 0 representing an off status, and a value of 1 representing an actuated status. Line 528 can represent the status of the trigger switch 18*a*, with a value of 0 representing an off status, and a value of 1 representing an actuated status. The horizontal axes represent time in seconds.

At point 510, the contact trip switch 50 is actuated, causing electrical current 514 to flow to the motor 32. In the example provided, the current 514 to the motor 32 increases over time at a steady rate causing the speed 518 at which the flywheel 34 rotates to increase at a steady rate. The speed 518 of the flywheel 34 can increase until reaching a first predetermined speed 522 (e.g., the firing speed). In the example provided, the first predetermined speed 522 is approximately 13,000 revolutions per minute, though other configurations can be used. In the example provided, the current 514 increases at a rate such that the flywheel 34 reaches the first predetermined speed 522 in approximately 0.5 seconds, though other configurations can be used. In the example provided, the controller 54 is configured to limit the maximum current output to the motor 32 to a predetermined current limit (e.g., 60 amps), though other configurations can be used. In the example provided, the current 514 increases at a rate such that the speed 518 of the flywheel 34 reaches the first predetermined speed 522 before the current 514 reaches the predetermined current limit.

In an alternative configuration, not specifically shown, the current 514 can rise at a faster rate, such that the current 514 reaches the predetermined current limit prior to the flywheel 34 reaching the first predetermined speed 522. In such a configuration, the current 514 can be applied at a constant magnitude at the predetermined current limit until the flywheel 34 reaches the first predetermined speed 522. Alternatively, the current 514 can repeatedly drop below the predetermined current limit and ramp back up to the predetermined current limit until the flywheel 34 reaches the first predetermined speed 522.

Returning to the example provided, the first predetermined speed 522 can be sufficient to drive the driver 28 to fire the fastener F into the workpiece (not shown). When the flywheel 34 reaches the first predetermined speed 522, the current 514 to the motor 32 can be reduced or intermittently shut off to maintain the flywheel 34 at or above the first predetermined speed 522 until the kinetic energy of the flywheel 34 is needed for firing. In the example provided, the flywheel 34 reaches the first predetermined speed 522 at point 530 and the current 514 to the motor 32 is shut off at point 524.

In the example provided, the trigger switch 18*a* is actuated at point 526. In the example provided, the contact trip switch 50 is still actuated, the trigger switch 18*a* is actuated at point 526, the trigger switch 18*a* was actuated after the contact trip switch 50, and the flywheel 34 is at the first predetermined speed 522. Thus, the controller 54 activates the actuator 44 by providing electrical current 514 to the actuator 44 at point 534. Electrical current 514 can be applied to the actuator 44 in a pulse over a predetermined amount of time (e.g., approximately 30 milliseconds). At point 534, the actuator 44 can cause the driver 28 to engage the flywheel 34 to fire the fastener F, as described above.

In other words, the conditions required for firing the fastener in rapid sequential mode can be the same as those for firing in the sequential mode: the contact trip 20 is currently actuated, the trigger switch 18*a* is currently actuated, the trigger 18 was actuated after the contact trip switch 50, and the speed 518 of the flywheel 34 is at the first predetermined speed 522. Thus, in the example provided, despite the trigger switch 18*a* being actuated at point 526, after point 310, the fastening tool 10 does not operate the actuator 44 to fire the fastener F until the flywheel 34 reaches the first predetermined speed 522 at point 530. In the example provided, electrical current 514 is not provided to the motor 32 while the actuator 44 is operated and is not provided while the driver 26 engages the flywheel 34.

While not specifically shown in FIG. 5, if the flywheel 34 reaches the first predetermined speed 522 before the trigger switch 18*a* is actuated, the current 514 can be reduced to maintain the speed 518 at the first predetermined speed 522 until the trigger switch 18*a* is actuated (e.g., to fire the fastener F), the contact trip switch 50 is no longer actuated (e.g., to turn off power to the motor 32), or for a predetermined amount of time (e.g., 10 seconds then turning off power to the motor 32), whichever occurs first.

After firing the fastener F, the return mechanism (not shown) can cause the driver 26 to return to its original axial position, and a new fastener F can be positioned for subsequent firing.

After providing current 514 to the actuator 44 to fire the fastener F, the controller 54 can wait a predetermined amount of time (e.g., 30 milliseconds) to allow the driver 26 to disengage the flywheel 34. After the predetermined amount of time set to allow the driver 26 to disengage the flywheel 34 (e.g., at point 536) the controller 54 can cause current 514 to flow to the motor 32 to increase the speed 518 of the flywheel 34 until the flywheel 34 reaches a second predetermined speed 544, without additional input from the user. In the example provided, the second predetermined speed 544 is equal to the first predetermined speed 522, though other configurations can be used. In one such alternative configuration, the second predetermined speed 544 is less than the first predetermined speed 522, but greater than the speed of the flywheel 34 immediately after firing a fastener F.

In the example provided, the current 514 to the motor 32 is ramped up to point 550 in a similar manner as when the contact trip switch 50 was actuated at point 510. At point 546, the speed 518 of the flywheel 34 reaches the second predetermined speed 544.

In the example provided, once the controller 54 detects that the flywheel 34 is rotating at the second predetermined speed 544, the controller 54 maintains a reduced amount of current 514, greater than zero (e.g., 3 amps), to the motor 32 to maintain the flywheel 34 at the second predetermined speed 544. The controller 54 maintains the flywheel 34 at the second predetermined speed 544 for a predetermined amount of time after the preceding firing of the fastener F. While not specifically shown in FIG. 5, following the predetermined amount of time of maintaining the second predetermined speed 544, the controller 54 stops current from flowing to the motor 32 and the flywheel 34 is permitted to come to a rest until another input from the user (e.g., actuation of the contact trip 20 or the trigger 18) causes the controller 54 to again provide current 514 to the motor 32.

In the example provided, the contact trip switch 50 is released at point 532 and the trigger switch 18*a* is released at point 540. The contact trip switch 50 is next actuated at point 538. The trigger switch 18*a* is next actuated at point 542, after point 538 (i.e., after actuation of the contact trip switch 50). Unlike the sequential mode, since the flywheel 34 is already at second predetermined speed 544, there is no delay of time between when firing is requested by the user (e.g., actuation of the trigger switch 18*a*) and the subsequent firing of the fastener F. Thus, since all the conditions for firing the fastener F are met, the fastener F can be fired. At point 552, the controller 54 turns off power to the motor 32 and at point 554, provides current 514 to the actuator 44 to cause the driver 26 to engage the flywheel 34 at point 554 and fire the fastener F.

Figure 6:
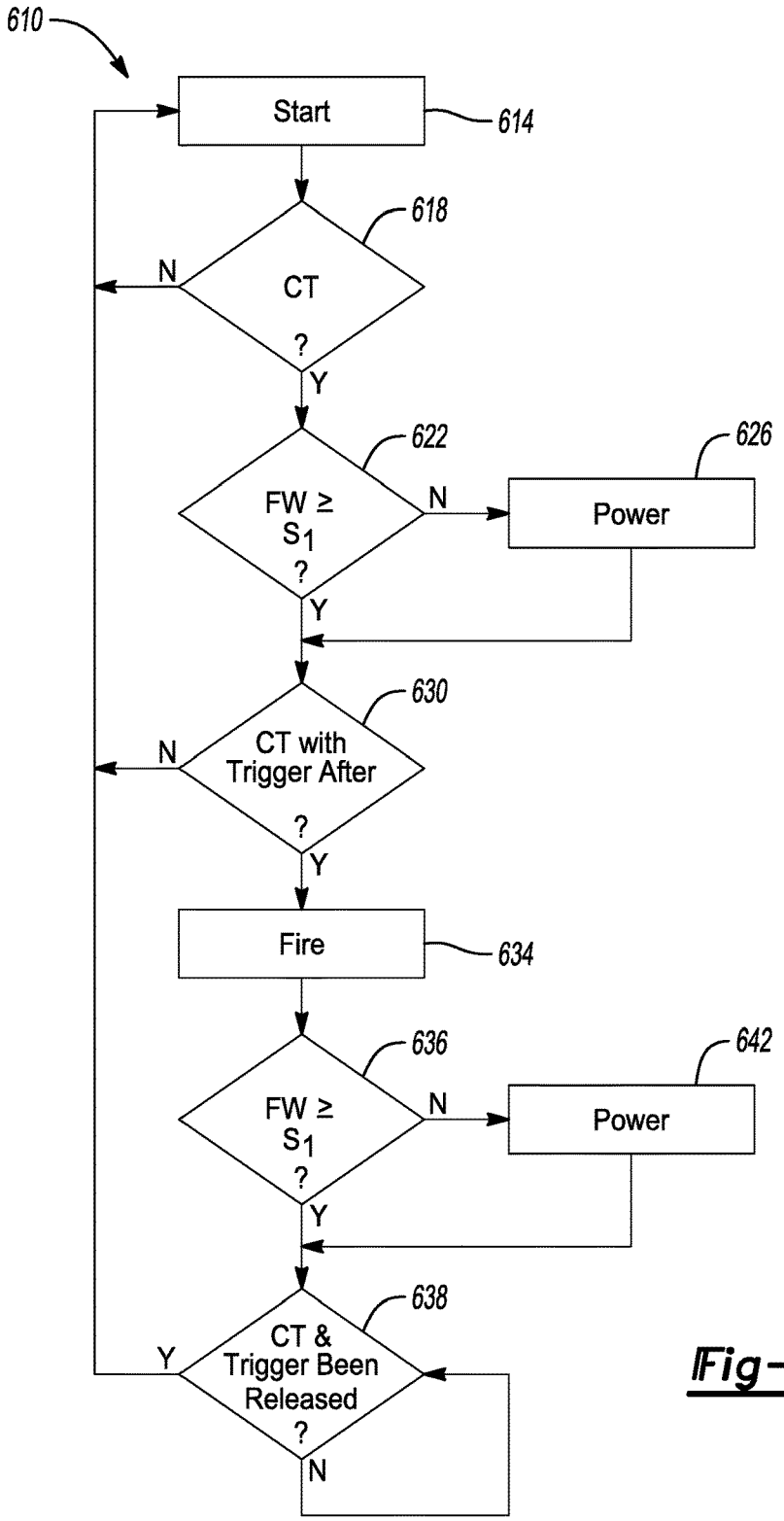
FIG. 6 is a diagram of a logic routine for operating the fastening tool of FIG. 1 in the rapid sequential mode.

With continued reference to FIGS. 2 and 5, and additional reference to FIG. 6, FIG. 6 illustrates an example diagram of a logic routine 610 for use by the controller when in the rapid sequential mode. The logic routine 610 can begin at step 614 and proceed to step 618. At step 618, the controller 54 can check if the contact trip switch 50 has been actuated. If the contact trip switch 50 has not been actuated, then the logic routine 610 can return to step 614. If the contact trip switch 50 is actuated, then the logic routine 610 can proceed to step 622.

At step 622, the controller 54 can check if the speed 518 of the flywheel 34 is greater than or equal to the first predetermined speed 522. If the speed 518 is not greater than or equal to the first predetermined speed 522, then the logic routine 610 can proceed to step 626. At step 626, the controller 54 can cause electrical current 614 to flow to the motor 32 to speed up the flywheel 34 until the speed 518 is greater than or equal to the first predetermined speed 522. In the example provided, the amplitude of the electrical current 514 can be ramped up, as shown in FIG. 5 (e.g., between points 510 and 524), or ramped up and then held constant at the first predetermined speed 522 until all conditions for firing the fastener F are met, or for the predetermined amount of time (e.g., 10 seconds), as discussed above. After step 626, the logic routine 610 can proceed to step 630.

Returning to step 622, if the speed 518 of the flywheel 34 is greater than or equal to the first predetermined speed 522, then the logic routine 610 can proceed to step 630. At step 630, the controller 54 can check if the contact trip switch 50 was actuated after the trigger switch 18*a*. If the trigger switch 18*a* was actuated before the contact trip switch 50, then the logic routine 610 can return to step 614. If the trigger switch 18*a* was actuated after the contact trip switch 50, then the logic routine 610 can proceed to step 634. In an alternative construction, not specifically shown, the controller 54 can check the order of actuation of the trigger switch 18*a* and the contact trip switch 50 before checking the speed 518 of the flywheel 34.

At step 634, the controller 54 can turn off power to the motor 32 and activate the actuator 44 to cause the driver 28 to engage the flywheel 34 and fire the fastener F, as described above (e.g., at points 524 and 534 of FIG. 5). After firing the fastener F, the logic routine 610 can proceed to step 636. At step 636, the controller 54 can check if the speed 518 of the flywheel 34 is greater than or equal to the second predetermined speed 544. If the speed 518 of the flywheel 34 is greater than or equal to the second predetermined speed 544, then the logic routine 610 can proceed to step 638. If the speed 518 of the flywheel 34 is not greater than or equal to the second predetermined speed 544, then the logic routine 610 can proceed to step 642.

In one configuration, the controller 54 can wait a predetermined amount of time (e.g., 30 milliseconds) between providing power to the actuator 44 and proceeding to step 636, such that the driver 26 can disengage from the flywheel 34 before proceeding to step 636.

At step 642, the controller 54 can cause electrical current 514 to flow to the motor 32 to speed up the flywheel 34. The controller 54 can speed up the flywheel 34 until it is at the second predetermined speed 544 and can maintain the flywheel 34 at the second predetermined speed 544 for a predetermined amount of time (e.g., 1-5 seconds). While not specifically shown, the controller 54 can shut off power to the motor 32 before the predetermined amount of time if the user provides input indicating that power is not desired. After step 642, the logic routine 610 can proceed to step 638.

In an alternative configuration, not specifically shown, the step 642 can directly follow step 634, and step 636 can directly follow step 642. In this alternative configuration, the controller 54 begins to ramp up power to the motor 32 before initially checking the speed 518 of the flywheel 34.

Returning to the example provided, at step 638, the controller 54 can check if both of the contact trip switch 50 and the trigger switch 18*a* have been released. Once the contact trip switch 50 and the trigger switch 18*a* have been released, the logic routine 610 can return to step 614. Thus, a subsequent fastener F cannot be fired until both the contact trip switch 50 and the trigger switch 18*a* have been released.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

In this application, including the definitions below, the term "module" or the term "controller" may be replaced with the term "circuit." The term "controller" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The controller may include one or more interface circuits. In some examples, the interface circuits may include wired or wireless interfaces that are connected to a local area network (LAN), the Internet, a wide area network (WAN), or combinations thereof. The functionality of any given controller of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A fastening tool for installing fasteners into a workpiece, the fastening tool comprising:

a contact trip switch;

a trigger switch;

a driver that is movable along a driver axis;

a motor assembly including a motor, a flywheel, and an actuator, the flywheel being driven by the motor, the actuator configured to cause the driver to engage the flywheel to cause the driver to move along the driver axis; and a controller configured to selectively operate the motor and to selectively operate the actuator;

wherein the controller has a first state in which the controller is configured to not operate the actuator unless: a) the contact trip switch and the trigger switch are both actuated, b) the contact trip switch is actuated prior to actuation of the trigger switch, and c) the flywheel is rotating at least at a first predetermined speed; and wherein in the first state, the controller is configured to operate the motor to rotate the flywheel to at least a second predetermined speed while each of the contact trip switch and the trigger switch are deactuated after an operation of the actuator until the earlier of: a) a second predetermined period of time after the operation of the actuator, or b) a subsequent operation of the actuator after the operation of the actuator.

2. The fastening tool of claim 1, wherein in the first state and with at least one of the contact trip switch or the trigger switch is actuated, the controller is configured to operate the motor to rotate the flywheel at the first predetermined speed for a first predetermined period of time.

3. The fastening tool of claim 1, wherein the controller has a second state in which the controller is configured to not operate the actuator unless the contact trip switch and the trigger switch are both actuated, the contact trip switch being actuated prior to actuation of the trigger switch, and the flywheel is rotating at the first predetermined speed, wherein in the second state, the controller is configured to not operate the motor after operation of the actuator until receiving a subsequent input.

4. The fastening tool of claim 3, wherein in the second state and with at least one of the contact trip switch or the trigger switch is actuated, the controller is configured to the motor to rotate the flywheel at the first predetermined speed for a first predetermined period of time.

5. The fastening tool of claim 1, wherein the second predetermined amount of time is between 1 second and 5 seconds.

6. The fastening tool of claim 1, further comprising a power source sensor configured to sense a condition of the motor assembly that is indicative of a level of kinetic energy of the flywheel.

7. The fastening tool of claim 6, wherein the power source sensor includes at least one Hall Effect sensor.

8. The fastening tool of claim 1, wherein the fastener is a nail and the driver is configured to drive the nail from the fastening tool into a workpiece.

9. The fastening tool of claim 1, wherein in the first state the controller is configured to wait a third predetermined period of time after the operation of the actuator before operating the motor to rotate the flywheel at the second predetermined speed for the second predetermined period of time.

10. The fastening tool of claim 9, wherein the third predetermined period of time is sufficient to permit the driver to disengage the flywheel.

11. The fastening tool of claim 1 wherein in the first state the controller is configured to not operate the motor to rotate the flywheel at the second predetermined speed for the second predetermined period of time until the driver disengages the flywheel.

* * * * *